United States Patent [19]

Reimers

[11] Patent Number: 4,676,464

[45] Date of Patent: Jun. 30, 1987

[54] GOLF BAG WITH INTEGRAL STAND

[76] Inventor: Eric W. Reimers, 235 N. First St., Missoula, Mont. 59802

[21] Appl. No.: 783,769

[22] Filed: Oct. 3, 1985

[51] Int. Cl.[4] ..... A63B 55/00

[52] U.S. Cl. ..... 248/96; 206/315.5; 206/315.7

[58] Field of Search ..... 248/96, 95, 97, 169, 248/168, 167, 170; 206/315.3, 315.5, 315.6, 315.7, 315.8

[56] References Cited

U.S. PATENT DOCUMENTS

| | | | |
|---|---|---|---|
| 1,791,188 | 2/1931 | Bright | 248/96 |
| 1,895,366 | 1/1933 | Beard | 248/96 |
| 1,975,702 | 10/1934 | Sterling | 248/96 |
| 2,571,088 | 10/1951 | Walton | 248/96 |
| 2,663,528 | 12/1953 | Hadley | 248/96 |
| 2,676,737 | 4/1954 | Zirbel | 206/315.3 |
| 2,749,069 | 6/1956 | Sandstrom | 248/96 |
| 3,435,866 | 4/1969 | Cantwell | 248/96 X |
| 4,226,389 | 10/1980 | Neth | 248/96 |
| 4,266,589 | 5/1981 | Cochran | 206/315.5 |
| 4,453,686 | 6/1984 | Ina | 248/168 |
| 4,506,854 | 3/1985 | Kim | 248/96 |
| 4,620,682 | 11/1986 | Yim | 248/96 |

*Primary Examiner*—Ramon O. Ramirez
*Attorney, Agent, or Firm*—Michael J. Hughes

[57] ABSTRACT

A golf bag with integral stand (10) that allows the bag portion (12) to rest in a semi-upright position. The bag portion (12) is supported while at rest by two support members (28 and 29). The positioning of these members (28 and 29) is controlled by a pair of transverse members (30 and 36), to which force is applied by means of a sling, or bag strap (32). The range of motion of the support members (28 and 29) is limited by restraining posts (40, 42, 44, and 46) in the preferred embodiment or by stops (148, 150, and 152) in an alternate embodiment. Limiting the range of motion of the support members (28 and 29) ensures that they will be in the appropriate position both while the bag 10 is being carried and while it is at rest.

The open end (20) of the bag portion (12) is supported by a rigid collar (22) containing cross members (24) to provide for separation of the clubs. Further, the preferred bag portion (12) has a cross section with the shape of a rounded triangle. The bag (10) will be of great utility to a great many golfers, and will be marketed wherever golf equipment is sold.

12 Claims, 5 Drawing Figures

GOLF BAG WITH INTEGRAL STAND

TECHNICAL FIELD

The present invention relates generally to sporting goods and more specifically to golfing equipment.

BACKGROUND ART

Golf is a game that has been popular in many parts of the world for many generations. Part of the game's popularity is due to the fact that it is one of the few "life sports". That is, complete retirement because of age is rarely necessary. Golf provides an excellent vehicle for reasonable exercise for an extremely wide range of people.

The nature of the game requires that a substantial amount of equipment (e.g. clubs) be carried with the golfer as he moves about the course. There are several methods available to accomplish this, among them being the power cart, the hand-pulled cart, and the hiring of a caddy. However, the golfing purist or the person wishing to maximize the amount of exercise obtained from a round of golf will carry his or her own clubs. Carrying additional weight while exercising will clearly increase the strain on the cardiovascular and muscular systems. This increased strain, within healthful limits, is exactly the desired product of exercise.

The problem inherent in carrying one's own golf bag is that they can be somewhat awkward. This awkwardness manifests itself not only in the carrying but also in finding something to do with the bag while making a shot. Minimal experience will teach a golfer that simply tossing the bag on the ground may provide more club retrieving activity than is desired. Helpful trees and other surfaces to prop the bag against are not always available and are notoriously fickle as well. Backstrain from bending to the ground to pick out clubs and to lift the bag is a common result.

To combat this problem, inventive golfers have created a multitude of prior art devices to keep the bag in a semi-upright position. These devices can be grouped very generally into four categories.

The first type of device is an independent support. These devices are designed to be "added on" to the golf bag. An early example of these devices is Arthur Smith's "Golf-Bag Holder", U.S. Pat. No. 1,548,169 dated Nov. 5, 1924. A somewhat more recent example is Warren R. Tolman's "Collapsible Stand for Golf Bags", U.S. Pat. No. 2,902,238, dated Feb. 4, 1958. These examples of the prior art have the disadvantage of being fixed in place. They therefore add effective volume to the bag, making it even more difficult to maneuver in close areas.

Another category in the prior art contains devices designed to hold the bag upright by means of a stake driven into the ground. Examples of this type of support appeared as early as Elmer T. Pocklington's "Device for Supporting Golf Bags", U.S. Pat. No. 1,548,169, issued Nov. 5, 1924. Devices of this nature appear periodically from that date to June 30, 1976, the issue date of the Panetta device, "Attachments for Golf Bags", U.S. Pat. No. 4,071,062. These devices have serious disadvantages in that a golfer may need to stand his or her bag in rocky ground or, perish the thought, sand. Also, the fact that many of the stakes in these devices are not retractable could present somewhat of a safety hazard to the golfer and others.

The most common type of device in the prior art seems to be a straight-forward tripod arrangement. The standard device of this type consists of two rigid support members attached to the bag, generally hinged for retraction, with the third leg of the tripod being the golf bag itself. The devices are myriad, an early example being George Parnall's "Stand for Golf Caddie-Bags and the Like", U.S. Pat. No. 1,135,464, dated June 18, 1914. A more recent device is that of Elwood Buck Jr. et al, "Support for a Golf Bag", U.S. Pat. No. 4,054,256, dated Aug. 18, 1976. The major disadvantage of these devices is that the golfer has to somehow engage the device every time the bag is set down, and disengage the device when the bag is picked up.

An effort to alleviate this problem can be seen in the fourth category of prior art. The devices in this category all have some means to "automatically" engage the device. Some of these devices are spring-loaded, an early example being Henry Henneberg's "Golf-Caddie-Bag Stand", U.S. Pat. No. 1,187,007, dated Nov. 1, 1915. This device makes use of a "spring pressed sleeve" that, when released, pushes the support legs into proper position. Other devices make some use of gravity in their operation. Murray D. Gallagher's "Golf Bag", U.S. Pat. No. 1,840,663, dated Feb. 24, 1930, is one such device. Francis Leigh Cox's "Stand for Golf Bags", U.S. Pat. No. 2,305,517, dated Sept. 8, 1941 is another. Both of these devices have the disadvantage of requiring a latching mechanism to secure the support legs when they are not in use. Also, the Gallagher device requires considerable extra hardware.

In sum, the prior art generally suffers from one or more of three major disadvantages: (1) The device for support is not integrated into the golf bag; (2) too much additional hardware is necessary, increasing the weight and effective volume; or (3) the device requires manual engagement and/or retraction.

DISCLOSURE OF INVENTION

Accordingly, it is an object of the present invention to provide a method of supporting a golf bag in a semi-upright position, the means of support being integrated into the structure of the golf bag itself.

It is another object of the present invention to provide a device that does not require the addition of significant bulky or heavy additional elements to the basic golf bag structure.

It is a further object of the present invention to provide a device that automatically engages and disengages.

It is yet another object of the present invention to provide a device that does not add significantly to the effective volume of the golf bag, such that bag storage is not made more difficult.

Briefly, the preferred embodiment of the present invention is a golf bag with integral stand. The bag portion itself has a generally triangular cross-section with rounded corners. It is closed at one end with a rigid base plate. In the preferred version the bag is formed to stand at an angle and a directly vertical position is inhibited. The opposite end is open, with a cross-membered collar to provide compartments to separate the clubs. An attachment assembly is situated at approximately the center of the collar on both lateral sides. This attachment assembly provides anchor and pivot points for the support members (legs) that comprise the structure which keeps the bag upright. Attached to the support members is a sling or bag strap used to carry the bag and also to position the support members. The mid-section of the sling is padded for extra comfort when the strap rests on the golfer's shoulder. One end of the sling is attached by means of a transverse nylon cord to the top of the support members. The other end of the sling attaches to the support members attaches at a selected point in a range formed approximately about their midpoint, by means of a pair of further transverse nylon cords and spring loaded clamps. The support members of the preferred embodiment are bent to provide optimal support when in the stand mode and minimal impedance in the carry mode.

An advantage of the present invention is that the structure providing support is integrated into the structure of the bag.

A further advantage of the present invention is that the simplicity of design results in very few additions being necessary to the basic bag construction.

Another advantage of the present invention is that there are minimal projections from the body of the bag, hence the effective volume and weight of the bag are not significantly increased.

Still another advantage of the present invention is that it is fully self-actuating in normal use, thereby providing maximum convenience to the golfer.

A still further advantage of the present invention is that it is easily and economically manufactured, and may be adapted for use with conventional bag structures.

These and other objects and advantages of the present invention will become clear to those skilled in the art in view of the best presently known mode of carrying out the invention and the industrial applicability of the preferred embodiment as described herein and as illustrated in the several figures of the drawing.

BEST MODE OF CARRYING OUT THE INVENTION

Figure 2:
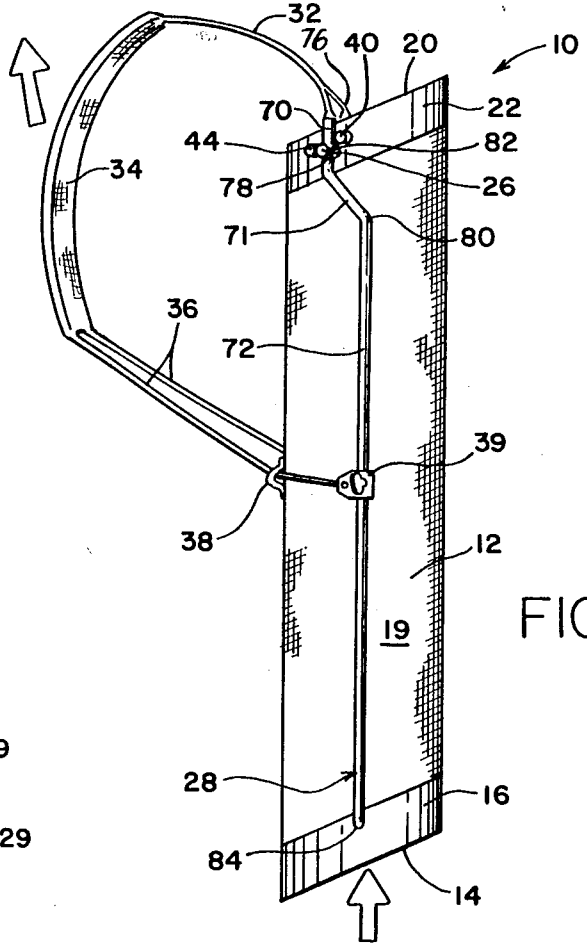
FIG. 2 is a left side elevational view of the invention, shown in the carry mode.

The present invention is a golf bag with integral stand, directed at providing a golf club carrying apparatus that will remain in a semi-upright position while the golfer is making his shot or resting. The preferred embodiment of the invention is illustrated in the drawing and described herein.

Figure 1:
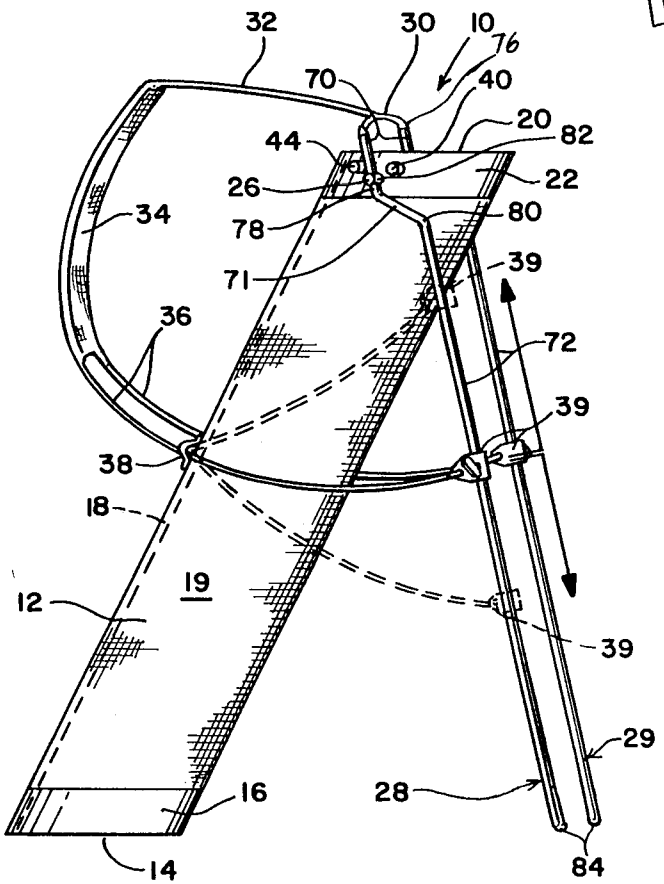
FIG. 1 is a left side elevational view a golf bag with integral stand according to the preferred embodiment the present invention, shown in the stand mode.

Referring to FIG. 1, the preferred embodiment of the golf bag is shown in a left side elevational view in the position it would assume while at rest, referred to as the "rest" or "stand" mode. The golf bag with integral stand of the present invention is referred to by the general reference character 10.

The major component of the invention 10 is a bag portion 12, generally describable as a diagonally cut cylindrical member having a transverse triangular cross-section with rounded corners and being closed at one end. An axial cross-section of the bag portion 12 yields a parallelogram having a rear base angle of approximately 67°. A closed end 14 is covered by a rigid base plate 16. In the preferred embodiment, a reinforcing spine 18 runs the length of the bag portion 12 to provide added rigidity. An enclosing casing 19 is provided to create a substantially enclosed volume to protect the contents of the bag portion 12. at an open end 20 of the bag portion 12 is a rigid collar 22. The collar is divided by multiple cross members 24 so that the bag portion 12 is compartmentalized. The cross members 24 are integral to the collar 22. The orientation of the cross-members 24 is not crucial, as their function is merely to divide the bag portion 12 into segments for ready separation of clubs and to provide improved balance.

In the preferred embodiment, a left pivot post 26 and a right pivot post 27 (shown in FIG. 3) are situated to extend outward from approximately the center of the sides of the collar 22. A left support member 28 is attached to the left pivot post 26, and a right support member 29 is attached to the right pivot post 27. The support members 28 and 29 are rigid rods of a length roughly equal to that of the bag portion 12, the length being dependent on the desired at-rest angle of the bag. The support members 28 and 29 are attached to the pivot posts 26 and 27 at pivot points 78 near the upper ends of the support members 28 and 29. The attachment must be such that the support members 28 and 29 pivot about the pivot posts 26 and 27.

Figure 3:
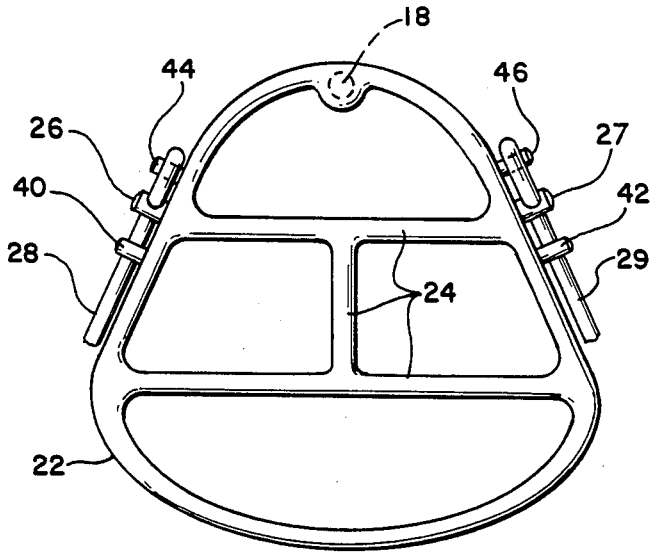
FIG. 3 is a top plan view of the bag portion of the preferred embodiment.

As may be seen in FIGS. 1, 2 and 3, the support members or legs 28 and 29 of the preferred embodiment are specially shaped to provide maximum support during the stand mode and maximum comfort with minimum discomfort and space utilization during the carry mode. For these purposes the preferred support members 28 and 29 are bent at opposing interior angles of 135°. The resulting double-bent legs 78 and 29 have a zigzag shape resembling a stylized lightning bolt.

Each support member 28 (or 29, since the members are symmetrical) includes a top segment 70, a transverse segment 71, and a leg segment 72. At the free end of the top segment 70 is a fastening anchor 76 to which a first transverse member 30 is attached. The top segment 70 intersects the transverse segment 71 at a 135° angle at the pivot point 78. The transverse segment 71 then intersects the leg segment 72 at a 135° angle at an elbow 80. The leg segment 72 culminates in a traction tip 84, which may be a sharpened end, a rubber sleeve or any other element which prevents slippage during the stand mode. A pivot post aperture 82 is provided in the support member 28 at the pivot point 78. The pivot post aperture 82 receives the pivot post 26 such that the support member 28 pivots readily.

The degree of bend of the pivot point 78 is selected such that in the stand mode (FIG. 1), the leg segments 72 intersect the ground at an angle of approximately 70°. The angle is such that the extrapolated axes of the leg segments 72 would intersect each other and the extrapolated axis of the spine member 18 at a single point, or approximately so. This provides for maximized stability. It is noted that, as shown in FIG. 3, the lateral surfaces of the collar 22 are angled outward from back to front. This shaping, combined with the orientation of the pivot posts 26 and 27, causes the traction tips 84 to be separated by a greater distance in the stand mode than in the carry mode.

A byproduct of the degree of bend at the pivot point 78 is that in the carry mode (FIG. 2) the leg segments 72 are aligned to be generally parallel to the spine member 18. This orientation keeps the leg members tight against the side of the bag portion 12 during carry mode such that there is minimal impact upon the golfers hip, side or leg during transport. The space utilization is also minimized for greatest efficiency of storage.

The degree of rotation of the top segment 70 about the pivot post 26 is restricted such that the stand mode and carry mode orientations are acheived.

In order to achieve this restriction the collar 22 is formed to include a left front restraining post 40, a right front restraining post 42 (see FIG. 3), a left rear restraining post 44 and a right rear restraining post 46 (see FIG. 3). The left restraining posts 40 and 44 are situated on the left side of the collar 22, and the right restraining posts 42 and 46 are situated on the right side of the collar 22. The rear restraining posts 44 and 46 are situated such that the top segments 70 abut against them when the bag 10 is in stand mode (FIG. 1). The position is selected to achieve the desired orientation of the leg segments 72. Similarly, the front restraining posts 40 and 42 provide stop means against which the top segments 70 abut during the carry mode (FIG. 2). The restriction of rotation provided by the orientation of these restraining posts 40, 42, 44, and 46 with respect to the pivot posts 26 and 27 is critical to the proper operation of the assembly 10.

The first transverse member 30 extends between the tops of the support members 28 and 29 and is attached to the anchors 76. This first transverse member 30 should be flexible or formed with a shape similar to that of the rear portion of the collar 22 so that the first transverse member 30 does not interfere with the collar 22 or the interior space of the bag portion 12. A nylon cord is preferred. One end of an adjustable sling or bag strap 32 is attached at the midpoint of the first transverse member 30 or, alternatively, slidably attached to the first transverse member 30 such that it will gravitate toward the effective center point thereof during usage. The sling 32 has a padded middle portion 34 (also known as a "shoulder pad") for providing greater comfort to the golfer. The remaining end of the sling 32 is attached at the midpoint of a second transverse member 36 or, alternatively, slidably attached as discussed above. The second transverse member 36 must be constructed of a flexible material and is preferrably a nylon cord. The second transverse member 36 is threaded through a guide 38. The guide 38 is simply a rigid, U-shaped element attached to the exterior of the bag portion 12 at approximately the midpoint of the reinforcing spine 18.

The second transverse member 36 is attached at each end to the leg segments 72 of the support members 28 and 29 by means of a slidable clamp 39. The clamps 39 are held in position either by a spring load or by a thumb operable set screw. In FIG. 1, phantom illustrations show the typical range of adjustment of the clamps 39 along the leg segments 72 of the support members 28 and 29. The purpose of the adjustable clamps 39 is to permit balancing of the bag 10 in accordance with the weight distribution of the contents. Although most of the weight of the bag 10 is borne by the guide 38 during carry mode the structure of the suspension system is such that there is a vertical component to the force vector applied to the support members 28 and 29 by the second transverse member 36 and the clamps 39. Adjustment of the positioning of the clamps 39 on the legs 72 is useful in optimizing the force vectors to provide the best possible balance and the greatest comfort to the golfer.

When the bag 10 is lowered, the rear tip of the base plate 16 is placed on the ground and the bag assembly 10 is permitted to tip forward while the sling 32 is still being held. In this manner the sling 32 acts to pull rearward the first transverse member 30 until the top segment 70 of the left support member 28 contacts the left rear restraining post 44, and the top segment 70 of the right support member 29 contacts the right rear restraining post 46. The support members 28 and 29 are thereby fixed in the proper position to maintain the bag 10 in a semiupright position while placed on the ground in stand mode.

Figure 4:
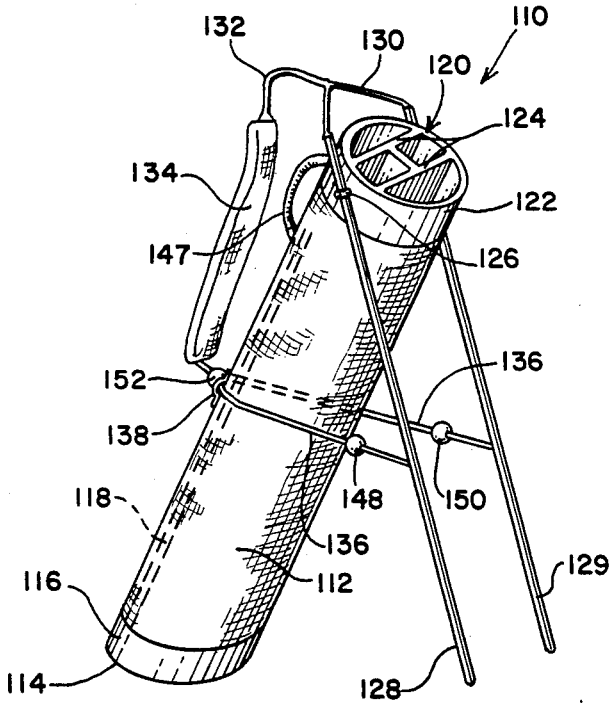
FIG. 4 is a perspective view of a first alternate embodiment.

A first alternate embodiment of the bag is illustrated in FIG. 4 and is designated by the general reference character 110. Most of the elements of the alternate embodiment 110 are common with those of the primary embodiment 10. The elements of the alternate embodiment 110 are specified by "100" series numerals. Those elements common to both embodiments will thus carry reference numerals which differ by 100.

The major differences between the preferred embodiment 10 and the first alternate embodiment 110 lie in the manner in which the terminal positions of the support members 28 and 29 are established and controlled. In the alternate embodiment 110 the clamps 39 and the restraining posts 40, 42, 44 and 46 are eliminated and replaced by similarly functioning elements as described below.

Also, the alternate golf bag assembly 110 is shown as having a truly cylindrical shape with a circular base plate 114 and collar 122 and a rectangular axial cross section. In sum, the bag portion 112 of the alternate assembly 110 is a conventional carry bag, even to the extent of including an auxillary carrying handle 147. One purpose of illustrating the alternate bag assembly 110 in this manner is to emphasize that the shape and general characteristics of the bag portion (12 and 112) is not critical to the usefulness and operation of the invention. So long as the shaping of the collar and bag are such that there is no interference with the pivotal rotation of the support members the shape selected is immaterial. The psuedo-triangular (prismatic) shape of the preferred embodiment 10 has simply been selected to provide maximum performance. The first alternate embodiment 110 is also illustrated with straight support members 128 and 129, rather than the bent members of the preferred embodiment.

In the first alternate embodiment 110, a first stop 148, a second stop 150, and a third stop 152 are affixed to the second transverse member 136. The stops 148, 150 and 152 are in the form of elements affixed to the second transverse member at selected points, with each stop being shaped such that it is incapable of passing through the guide 138. The first stop 148 and the second stop 150 are affixed on the support member side of the guide 138 while the third stop 152 is affixed to the second transverse member 136 on the sling 132 side of the guide 138. The positioning of the first stop 148 and the second stop 150 is such that when the bag assembly 110 is lifted, and the second transverse member 136 is pulled through the guide 138, the first stop 148 and second stop 150 contact the guide 138 when the support members 128 and 129 are parallel to the bag portion 112. The third stop 152 contacts the guide 138 when the bag 110 is lowered and the support members 128 and 129 has been pulled into the proper position to keep the bag assembly 110 in the appropriate semi-upright position. The third stop 152 prevents excess forward rotation of the support members in the stand mode.

Figure 5:
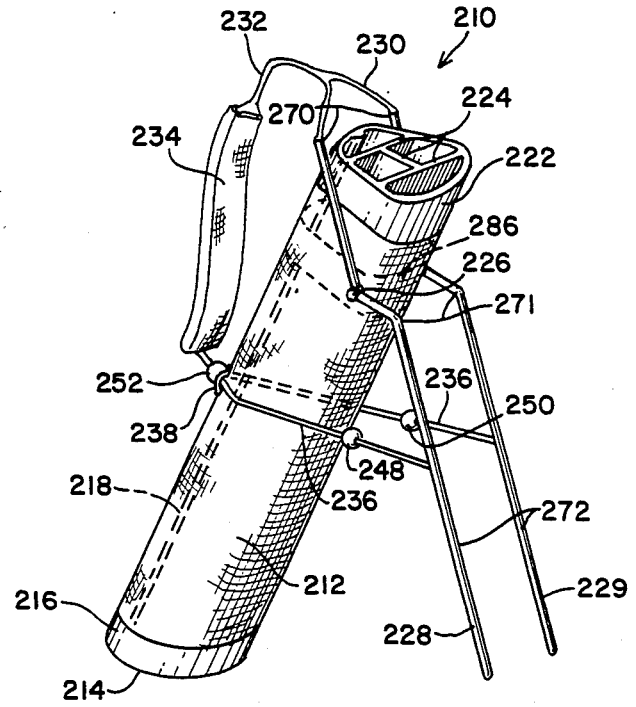
FIG. 5 is a perspective view of a second alternate embodiment.

A second alternate embodiment of the bag is illustrated in FIG. 5 and is designated by the general reference character 210. Most of the elements of the alternate embodiment 210 are common with those of the primary embodiment 10. The elements of the alternate embodiment 210 are specified by "200" series numerals. Those elements common to both the primary embodiment 10 and the second alternate embodiment 210 will thus carry reference numerals which differ by 200.

The major differences between the preferred embodiment 10 and the second alternate embodiment 210 are the shaping and attachment of the support members 28 and 29. In the alternate embodiment 210 the top segments 70 are lengthened, with a corresponding shortening of the leg segments 72, and the method and position of the attachment of the support members 28 and 29 to the bag portion 12 is altered as described below.

In the second alternate embodiment 210, the general shape of the support members 228 and 229 remains the same as in the primary embodiment 10, but the proportionate lengths of the components therof are altered to compensate for the different attachment position. The top segments 270 are lengthened, and the leg segments 272 are shortened. The transverse segments 271 remain the same.

This requires that, to maintain proper positioning, the pivot post 226 be approximately 15.2 cm (6.0 in.) below the collar 222. To facilitate this, an anchoring band 286 (shown in phantom) is attached to the interior of the bag portion 212.

The anchoring band 286 is made of a rigid material, preferrably heavy plastic or lightweight metal, to provide a solid attachment point for the support members 228 and 229.

An advantage of this alternate embodiment is that more leverage is available to position the support members 228 and 229.

Another advantage is that the pivot post 226 can be moved further away from the reinforcing spine 218. Thus a greater distance between the contact points of the support members 228 and 229 with the ground and the base 216 can be achieved with the same overall length of support member 228 or 229. This provides for even greater stability when the bag 210 is in the stand or rest mode.

The casing 19 is ordinarily selected to be a flexible material such as high grade nylon, leather or vinyl to provide maximum protection at minimum weight. Rigid casings 19 may also be utilized. Similarly, the base plate 16 and collar 22 are envisioned as being made of plastic, though any rigid material will suffice. It is also envisioned that the support spine 18, the pivot posts 26 and 27 affixing rod 26, the support members 28 and 29, and the restraining posts 40, 42, 44 and 46 will be constructed of solid aluminum, fiberglass or wooden rods.

The preferred support members 28 and 29 are selected to have dimensions commensurate with the desired positions and physical angles of the stand mode and the carry mode. For a situation such as the preferred embodiment 10, wherein the pivot posts 26 and 27 are situated in about the center of the lateral sides of the collar 22, the applicable approximate dimensions are as follows. The support members 28 and 29 will have a diameter of 1.27 cm (0.50 in). The top segments 70 will have a length of 10.2 cm (4.0 in). The transverse segments 71 will also have a length of 10.2 cm (4.0 in). The leg segments 72 have a length of 78.7 cm (31.0 in). The bag portion 12 itself will be approximately 86.4 cm (34.0 in) long. The pivot aperture has a diameter of 0.65 cm (0.26 in), slightly greater than that of the pivot posts 25 and 26. The front restraining posts 40 and 42 have a diameter of 0.64 cm (0.25 in) and are situated 2.5 cm (1.0 in) forward and 2.5 cm (1.0 in) above the pivot posts 26 and 27, with the top of the collar 22 assumed to be parallel to the horizontal. Similarly, the rear restraining posts 44 and 46, selected to have the same diameters as the front posts 40 and 42, are situated 2.5 cm (1.0 in) behind and 2.5 cm (1.0 in) above the pivot posts 25 and 26 which are situated in the vertical center of the collar 22. The length of the posts 25, 26, 40, 42, 44 and 46 is 1.6 cm (0.63 in).

Also, in one embodiment, it is envisioned that the first transverse member 30 and the second transverse member 36 are made of nylon cord. The only restriction (other than a requisite sturdiness) on materials for these elements is that the second transverse member 36 be very flexible.

For the alternate embodiment, the stops 148, 150, and 152 can be anything of sufficient size to block the motion of the second transverse member 136 through the guide 138. In one embodiment, the stops 148, 150, and 152 are plastic spheres with spring loaded plungers to fix them in place. This permits adjustment of position for desired results.

Those skilled in the art will readily observe that numerous modifications and alterations of the present device may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The golf bag with integral stand of the present invention will be useful to any golfer who desires to carry his or her own bag. It may persuade golfers who have previously used a cart to experiment with carrying their own bags. As mentioned before, carrying one's own bag enhances the healthful aspects of a round of golf.

The utility and applicability of the present invention is exemplified by the following discussion of typical usage. The golfer will place her or his clubs through the collar 22 into the bag portion 12 such that the club heads extend above the top of the open end 20. The clubs will ordinarily be arranged such that cross members separate the woods from the long irons and the long irons from the short irons.

Once this is accomplished the golfer will heft the bag assembly 10 by the sling 32 and test it for balance. Since club head weights and shaft lengths differ markedly between sets of clubs, this balance will differ significantly from golfer to golfer. It is then possible to slidably reposition the clamps 39 along the support members 28 and 29 until an optimal balance is achieved. The golfer is then ready to face the course.

When the first tee is reached the golfer will divest his or her shoulder of the bag assembly by setting the rear tip of the base plate 16 on the ground such that the club shafts and the reinforcing spine 18 lie in substantially vertical planes. The golfer maintains a grip on the sling 32 during this procedure. The force applied by the sling 32 to the first transverse member 30, in this orientation, causes the top segments 70 of the support members 28 and 29 to be pulled backward until they are arrested by the left rear restraining post 44 and the right rear restraining post 46, respectively. This concurrently causes the leg segments 72 of the support members to rotate forward into the stand mode illustrated in FIG. 1 (and FIG. 4). The force on the sling 32 is then gradually released such that the assembly 10 leans forward until the base plate 16 is flush with the ground and the spine 18 is at an angle of approximately 20° to 30° from vertical. This places the clubs in ideal position for inspection and removal by a standing golfer and also provides a very stable three point support to the bag, thereby preventing the assembly from tipping over.

After the shot has been made the golfer replaces the selected club in the bag portion 12 and prepares to move onward. The sling 32 is again grasped and the padded shoulder portion 34 is positioned on the golfer's shoulder. The length of the sling 32 has been previously adjusted such that when the shoulder pad 34 is centered on the shoulder the bag assembly 10 is in the carry mode (FIG. 2) and hangs comfortably with the club shafts and the reinforcing spine 18 being offset slightly from horizontal (pure horizontal alignment is undesirable as the clubs have a tendency to escape the bag 12).

When the bag assembly 10 is hefted into carry mode the lower end of the sling 32 applies force to the second transverse member 36 in such a manner that the second transverse member 36 is drawn back through the guide 38 and the support members 28 and 29 are caused to rotate backward until the rotation is arrested by the left front restraining post 40 and the right front restraining post 44, respectively. The leg portions 72 of the support members 28 and 29 will then be held against the side of the bag portion 12 such that they do not interfere with the golfer's body or unduly entangle with the environmental items which the golfer is likely to encounter while hunting for errant shots.

After the round, the assembly 10 may be easily stored in an automobile trunk in carry mode, where it is most compact, or if floor space is not at a premium, in stand mode, in the garage or storage shed. Suspension by the sling 32 is also feasible. In all phases of use, bending over and possible back strain are minimized.

One need only survey a few pro shops, sporting goods stores or sporting goods departments of department stores to realize the widespread market for golf equipment. A device such as the present invention, which increases convenience for a golfer while maintaining his exercise level, will, in all probability, be very popular in this market.

For the above reasons, it is expected that the golf bag with integral stand of the present invention will have widespread industrial applicability. Any golfer desiring to carry his own clubs, yet wishing to have a convenient stand for his bag, will appreciate the present invention. Therefore, it is expected that the commercial utility of the present invention will be quite widespread.

I claim:

1. A golf bag device, comprising:

a bag portion suited to enclose the shaft portions of golf clubs therein;

a pair of support legs pivotally attached to the bag portion; and sling means attached to the upper end of support legs, threaded through restraining means attached to the bag portion and attached to points on the pivotally opposing portions of each of the support legs, wherein the device is characterized by having a carry mode in which the sling means is pulled taut and the support legs lie flat against the sides of the bag portion and a rest mode in which the sling means is slack and the support legs extend forward from the bag portion so as to form two legs of a support tripod for the device, the remaining leg of said tripod being formed by the bottom of the bag portion.

2. The device of claim 1 wherein the device is symmetrical about a vertical plane including the major axis of the bag portion.

3. The device of claim 1 wherein the plane including the bottom surface of the bag portion is offest from perpendicularity to the axial plane of said bag portion.

4. The device of claim 3 wherein the angle of said offset is approximately 23°.

5. The device of claim 1 wherein the degree of pivotal rotation of the support legs is limited by restricting means such that said rest mode and said carry mode represent extreme rotational positions.

6. The device of claim 5 wherein said restricting means includes a pair of respective restraining posts offset from the pivot post about each of the support legs pivot.

7. The device of claim 5 wherein said restricting means includes a stop element situated on the sling means to restrict the travel of the sling means through said restraining means.

8. The device of claim 2 wherein the sling means includes:

a first transverse member, being attached at either end to the upper portion of each of said respective support legs;

a strap member attached at its upper end to the center of said first transverse member; and a second transverse member means attached to the lower end of said strap member, threaded through said restraining means and attached at extreme ends to discrete attachment points on the support legs.

9. The device of claim 8 wherein:

the precise location of said discrete attachment points is adjustable to compensate for weight distribution within the bag portion.

10. The device of claim 8 wherein said second transverse means is in the form of a cord threaded through said strap portion at its center point.

11. The device of claim 8 wherein said restraining means is a loop formed along the central top edge of the bag portion.

12. The device of claim 8 wherein said strap portion includes a padded central zone for provided cushioning to a shoulder during said carry mode.

* * * * *